US010295276B2

(12) United States Patent
Ghiani et al.

(10) Patent No.: US 10,295,276 B2
(45) Date of Patent: May 21, 2019

(54) HEAT EXCHANGER

(71) Applicant: MAHLE International GmbH, Stuttgart (DE)

(72) Inventors: Franco Ghiani, Bietigheim-Bissingen (DE); Thomas Strese, Schwaikheim (DE); Hicham Rouhana, Korntal-Muenchingen (DE); Roland Krisa, Stuttgart (DE); Chi-Duc Nguyen, Stuttgart (DE); Werner Helms, Esslingen (DE); Reinhard Heine, Leutenbach (DE)

(73) Assignee: MAHLE International GmbH, Stuttgart (DE)

( * ) Notice: Subject to any disclaimer, the term of this patent is extended or adjusted under 35 U.S.C. 154(b) by 284 days.

(21) Appl. No.: 14/564,457

(22) Filed: Dec. 9, 2014

(65) Prior Publication Data

US 2015/0159963 A1 Jun. 11, 2015

(30) Foreign Application Priority Data

Dec. 9, 2013 (DE) ..... 10 2013 225 326

(51) Int. Cl.
*F28F 7/00* (2006.01)
*F28F 1/10* (2006.01)
(Continued)

(52) U.S. Cl.
CPC ..... *F28F 1/10* (2013.01); *F28D 1/0443* (2013.01); *F28F 9/0209* (2013.01); *F28F 9/0224* (2013.01); *F28F 2265/26* (2013.01)

(58) Field of Classification Search
CPC ..... F28F 9/0229; F28F 9/0226; F28F 9/0224; F28F 9/0219; F28F 2265/26; F28D 1/0443; F28D 1/0426; B23P 15/26
(Continued)

(56) References Cited

U.S. PATENT DOCUMENTS 4,331,201 A * 5/1982 Hesse ..... B23P 11/00 165/149
4,461,348 A * 7/1984 Toge ..... F28F 9/0226 165/149

(Continued)

FOREIGN PATENT DOCUMENTS

DE 42 32 376 A1 3/1994
DE 10 2005 031 475 A1 3/2006

(Continued)

OTHER PUBLICATIONS

British Examination Report for British Application No. GB1421765.7 dated Feb. 19, 2016.

*Primary Examiner* — Jason N Thompson
(74) *Attorney, Agent, or Firm* — Muncy, Geissler, Olds & Lowe, P.C.

(57) ABSTRACT

A heat exchanger having a tube-fin block that is closed by two collecting tanks, whereby the ends of the tubes engage in a bottom of the particular collecting tank and the bottom is closed with a cover. A partition wall secured to the cover is formed transverse to a longitudinal extension of the collecting tank and divides an interior space of the collecting tank into two subchambers. The heat exchanger, which prevents great structural changes for compensating temperature-induced stresses, a first stress decoupling device is formed in the bottom and/or a second stress decoupling device in the area of the partition wall in the cover of at least one collecting tank.

8 Claims, 4 Drawing Sheets

(51) Int. Cl.
*F28F 9/02* (2006.01)
*F28D 7/06* (2006.01)
*F28D 1/04* (2006.01)

(58) Field of Classification Search
USPC ..... 165/172, 173, 176, 139, 81, 82
See application file for complete search history.

(56) References Cited

U.S. PATENT DOCUMENTS 4,546,823 A * 10/1985 Melnyk ..... F28F 9/0226 165/149
4,881,595 A * 11/1989 Damsohn ..... F28F 9/0226 165/173
4,899,815 A 2/1990 Bosch et al.
5,195,579 A * 3/1993 Buchanan ..... F28F 9/0224 165/149
5,758,721 A * 6/1998 Letrange ..... F28F 9/0226 165/149
5,848,639 A * 12/1998 Flesburg ..... F28D 1/0535 165/174
5,927,397 A 7/1999 Yasuda et al.
7,341,098 B2 * 3/2008 Brost ..... F28D 1/05366 165/149
2003/0205367 A1 * 11/2003 Shields ..... F28F 9/001 165/173
2007/0187077 A1 8/2007 Kwon et al.
2008/0271878 A1 * 11/2008 Harvey ..... F28D 1/0417 165/139
2011/0168372 A1 * 7/2011 Takahashi ..... F28D 1/0443 165/173
2013/0299147 A1 * 11/2013 Ghiani ..... F28F 9/00 165/168

FOREIGN PATENT DOCUMENTS

DE 10 2007 044 742 A1 4/2009
DE 10 2010 050 555 A1 7/2011
FR 2 785 376 A1 5/2000
WO WO 2007/104667 A1 9/2007

* cited by examiner

HEAT EXCHANGER

This nonprovisional application claims priority to German Patent Application No. DE 10 2013 225 326.5, which was filed in Germany on Dec. 9, 2013, and which is herein incorporated by reference.

BACKGROUND OF THE INVENTION

Field of the Invention

The present invention relates to a heat exchanger.

Description of the Background Art

DE 10 2005 031 475 A1 discloses a heat exchanger which has a tube-fin block closed on both sides by a collecting box. For receiving a coolant each collecting box has two side walls, two end walls, a cover, and a bottom arranged opposite to the cover. The bottom thereby comprises one or more openings for receiving tubes of the tube-fin block. The cover has a recess into which a partition wall extends dividing the interior space of the collecting tank into two subchambers.

In the conventional are, if one of two subchambers is formed as a high-temperature chamber and the other of the two chambers as a low-temperature chamber, high stresses occur that extremely strain the heat exchanger in the area of the partition wall. If a coolant flows through the high-temperature chamber, thermal stresses are created in the tubes. The thus arising forces from the high-temperature chamber are the cause for a bottom-surface shifting relative to the low-temperature chamber to occur. The shifting causes an expansion of the tubes at the bottom connection. As a result, defects can arise in the area of the partition walls, which occur, for example, as cracks in the tubes.

To prevent such disadvantageous defects, DE 10 2007 044 742 A1 discloses a heat exchanger in which the two chambers are separated not only spatially but are configured having a distance from one another.

However, conventional heat exchangers comprise a more complex structure increasing the assembly effort and thereby the production costs of the heat exchanger. Moreover, this type of design does not guarantee the complete prevention of damage to the tubes. The heat exchangers do not allow a sufficient temperature expansion compensation, because the cover of the heat exchanger is made of a continuous sheet profile.

SUMMARY OF THE INVENTION

It is therefore an object of the present invention to provide a heat exchanger in which the stresses in the transitional region between the high-temperature chamber and low-temperature chamber are relieved, without substantially increasing the costs for the production of the heat exchanger.

An exemplary embodiment relates to a heat exchanger, in which a first stress decoupling device is formed in the bottom and/or a second stress decoupling device in the area of the partition wall in the cover of at least one collecting tank. With the aid of such stress decoupling devices, stresses arising during the flow of a coolant from the high-temperature chamber into the low-temperature chamber can be prevented in a simple manner even if the high-temperature chamber is arranged not spaced apart but directly next to the low-temperature chamber. Tube expansions subjected to uncontrolled thermal loads are thereby compensated, because the stress decoupling device enables a shifting between the bottom and cover to one another. The formation of a stress decoupling device requires only little effort, which reduces the heat exchanger production costs.

According to an embodiment of the invention, in the case of the first stress decoupling device of the bottom, a slot, which is expanded by a further slot in the transverse direction of the bottom, runs in the longitudinal direction of the bottom. A controlled attenuation of the stiffness between the cover and bottom in the area of the partition wall occurs via such a stress decoupling device. The stresses applied to the tubes are reduced by this increased mobility of the bottom. Despite such stress decoupling devices, the heat exchanger always still has a sufficient pressure resistance, so that no medium flowing in the heat exchanger can leak outside.

In an embodiment, the cover can be connected to the bottom by a flange, particularly by a corrugated slot flange. The different material stresses on the tubes can be easily relieved by the open first stress decoupling device of the bottom in the area of the partition wall. The stress reduction occurs by the now possible step offset of the base plane of the bottom between the high-temperature chamber and the low-temperature chamber.

In an embodiment, the second stress decoupling device can have a corrugated configuration in the cover. Thus, the cover can create a step offset between the high-temperature and the low-temperature chamber. In addition to the variable offset of the base plane, the cover can follow this compensatory movement of the bottom.

In an embodiment, the corrugation can be formed V- or U-shaped. As a result, the load due to higher stresses on the tubes is minimized. A further structural modification of the cover for stress decoupling can be omitted.

In an embodiment, the cover can be lowered in the area of the partition wall in the direction of the bottom, whereby the partition wall is formed between the corrugation and the circumferential border forming the base of the cover. This assures that the high-temperature chamber and the low-temperature chamber are securely delimited from one another.

Advantageously, the height of the partition wall resting on the bottom can correspond to≤50% of the total height of the cover. As a result, sufficient movement of the cover in the case of the introduced corrugation in regard to the stresses arising between the high-temperature chamber and low-temperature chamber is assured, as a result of which the cover can follow the movement of the bottom.

In an embodiment, the height of the partition wall can correspond to 1 to 100% of the height of the circumferential sheathing of the cover. As a result, reliable closing devices, which are provided for connecting a corrugated slot flange of the sheathing of the cover with the bottom, can be used without modification. Moreover, a lower force application is necessary in connecting the cover with the bottom.

In a further embodiment, a seal, particularly a sealing frame, can be arranged between the partition wall and the bottom.

In an embodiment, the first stress decoupling device of the bottom can be formed as an attenuation elasticity. Such attenuation elasticities assure that the bottom itself can react to the acting stresses and can contribute to a compensation, whereby the stiffness of the bottom at the tubes engaging in the bottom is reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
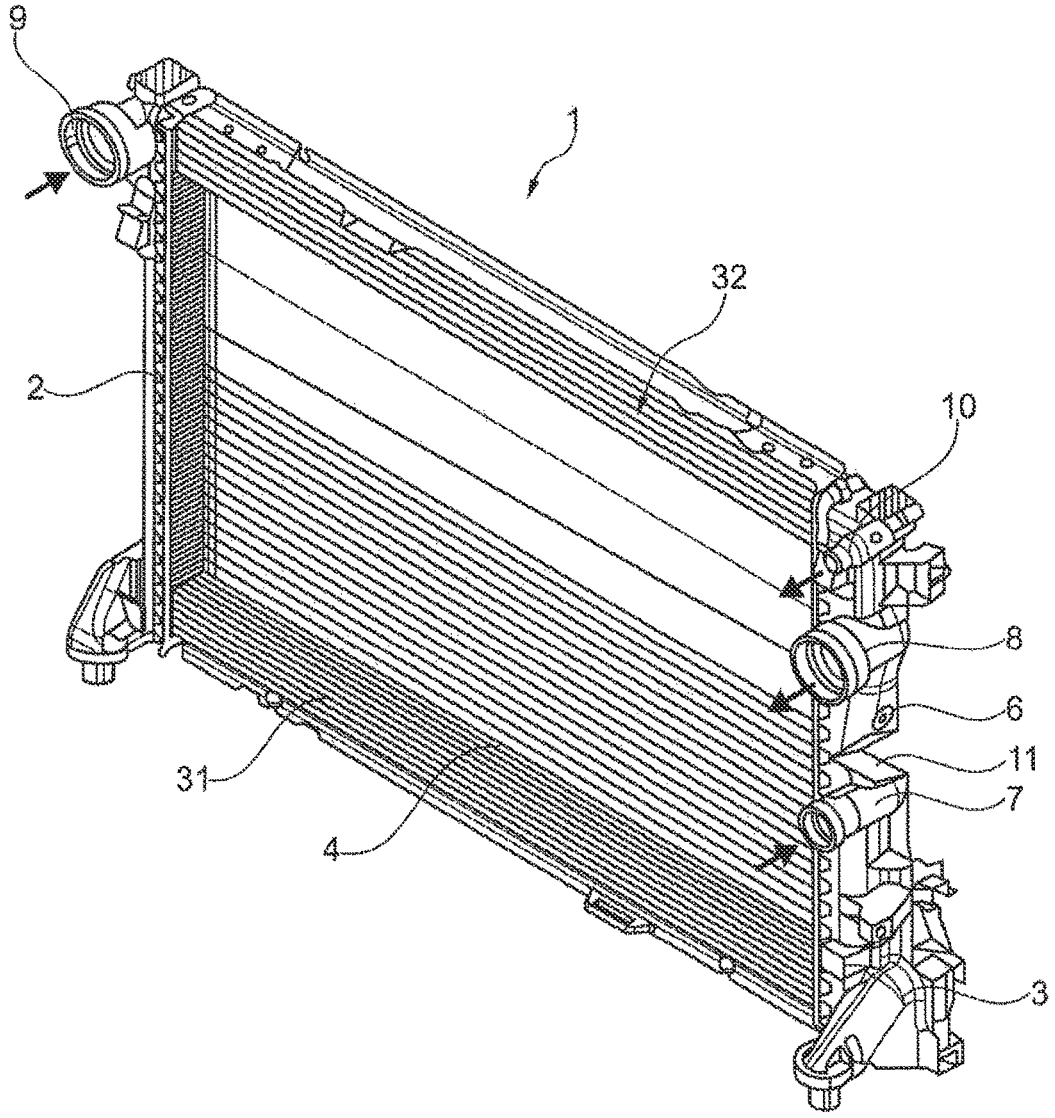
FIG. 1 shows an exemplary embodiment of a heat exchanger according to an embodiment of the invention.

FIG. 1 shows a first exemplary embodiment of heat exchanger 1 of the invention. Heat exchanger 1 has two collecting tanks 2, 3, between which a tube-fin block 4 is disposed. Tubes 5 formed within tube-fin block 4 engage with their respective ends in collecting tanks 2 or 3. Collecting tank 3 has a recess 6, to which in the interior a partition wall 12 attaches, which divides collecting tank 3 into a high-temperature region 31 and a low-temperature region 32. This means that the illustrated heat exchanger 1 has a main circuit, which is realized by high-temperature region 31, and an integrated auxiliary circuit, which is formed by low-temperature region 32. Partition wall 12 in this case prevents the fluids to be cooled from intermixing within collecting tanks 2 and 3. High-temperature region 31 in this case has a medium supply connector 7 and a medium outlet connector 8. Low-temperature region 32 also comprises a medium supply connector 9 and a medium outlet connector 10, whereby medium supply connector 9 is formed on collecting tank 2, whereas medium outlet connector 10 is positioned on collecting tank 3. In contrast, for high-temperature region 31 medium supply connector 7 and medium outlet connector 8 are both disposed on collecting tank 3. Next to recess 6, to which partition wall 12 is attached within collecting tank 3, a V-shaped corrugation 11 (i.e., second stress decoupling device) is routed in cover 13 of collecting tank 3.

Figure 2:
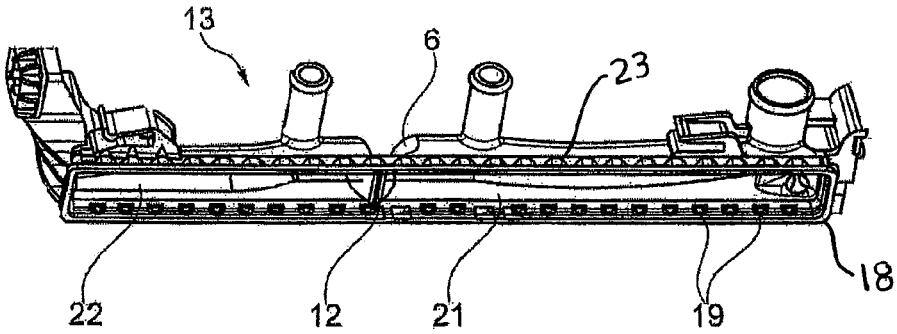
FIG. 2 shows an exemplary embodiment of a heat exchanger according to an embodiment of the invention.

A plan view of cover 13 of collecting tank 3 is shown in FIG. 2, from which it emerges that partition wall 12, which runs transverse to the longitudinal extension of cover 13, is formed opposite to recess 6. FIG. 2 also shows that a circumferential border 18 of the cover 13 has a corrugated flange 23.

Figure 3:
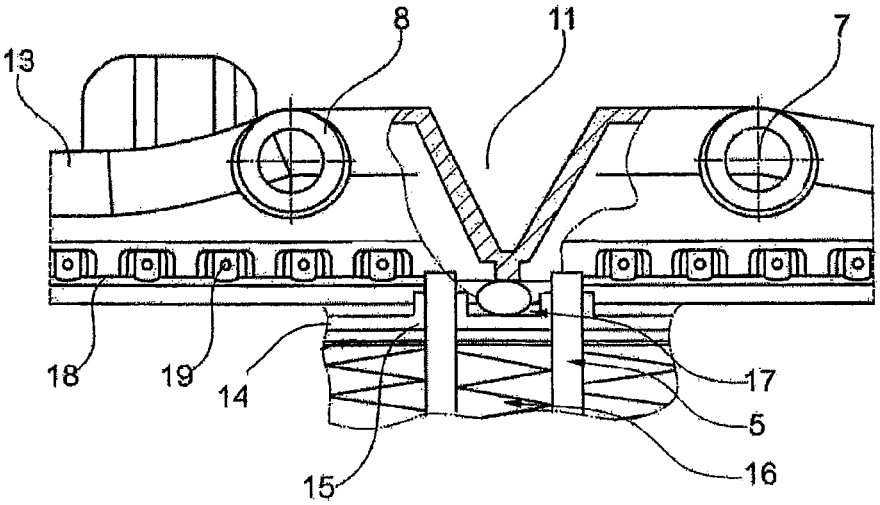
FIG. 3 shows an exemplary embodiment of a heat exchanger according to an embodiment of the invention.

As is shown in FIG. 3, each collecting tank 2, 3 has a cover 13 and a bottom 14. Bottom 14 in this case has openings 15 into which tubes 5 of tube-fin block 4 extend. Between tubes 5, fins 16 are formed by means of which the heat transfer between the air, flowing along fins 16, of the internal combustion engine and the coolant flowing in tubes 5 is increased. A sealing frame 17 is formed between bottom 14 and V-shaped corrugation 11.

Figure 4:
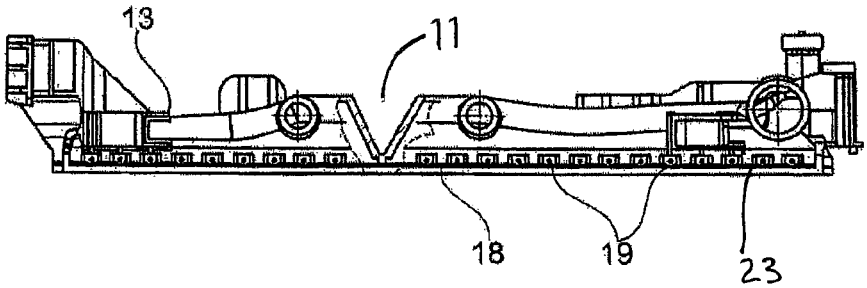
FIG. 4 shows an exemplary embodiment of a heat exchanger according to an embodiment of the invention.

FIG. 4 shows that cover 13 has the circumferential border 18. Cover 13 is connected to bottom 14 via the corrugated flange 23, whereby bottom 14 is clamped under cover 13.

Figure 5:
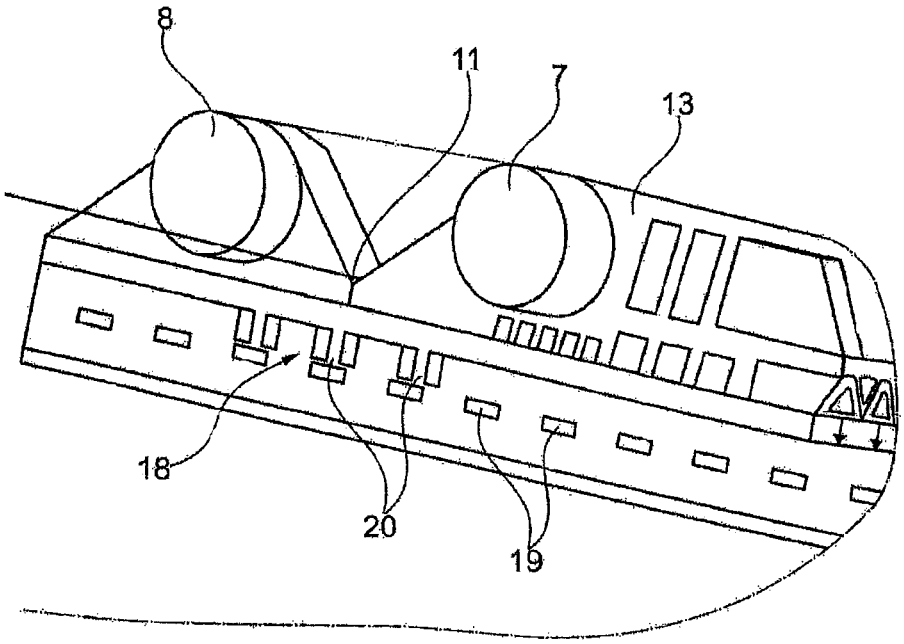
FIG. 5 shows an exemplary embodiment of a heat exchanger according to an embodiment of the invention.
Figure 6:
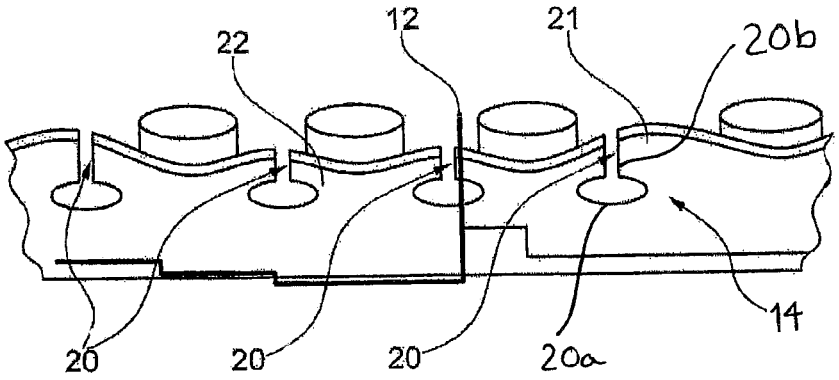
FIG. 6 shows a functional illustration of the heat exchanger of the invention according to FIG. 1.

A section of FIG. 4 is shown in FIG. 5, from which it is evident that slots 20 (i.e., first stress decoupling device), which make bottom 14 more movable, are introduced in bottom 14. As shown in FIG. 6, slots 20 comprise a slot **20*a* in the longitudinal direction of bottom 14, which is expanded by a slot 20*b* in the transverse direction of the bottom. The mode of action of these slots 20 will be explained in greater detail by using FIG. 6. Because slots 20 of bottom 14 are preferably formed in the area of partition wall 12, they enable a step offset of bottom 14 between high-temperature chamber 21 and low-temperature chamber 22. Stresses transmitted via bottom 14 to tubes 5 are relieved thereby, as a result of which damage to tubes 5** is prevented.

Figure 7:
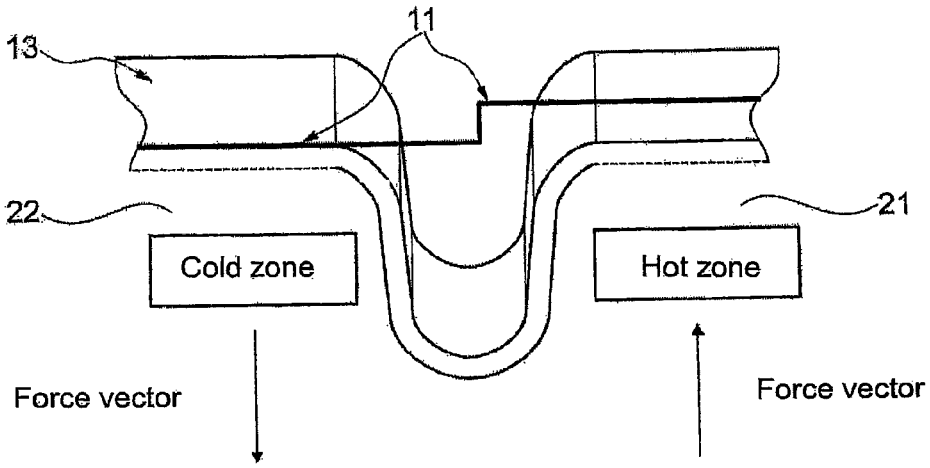
FIG. 7 shows a functional illustration of the heat exchanger of the invention according to FIG. 5.

Corrugation 11 of cover 13 has a similar effect, as is evident from FIG. 7. Forces that move bottom 14 relative to low-temperature chamber 22, are applied in high-temperature chamber 21, as a result of which an offset is formed. This offset can be compensated by the movement of cover 13, which is realized by corrugation 11. The expansion arising therefrom at tubes 5 is thus prevented.

It is conceivable that in addition to corrugation 11 of cover 13 and slots 20 of bottom 14, bottom attenuations (not shown further) are introduced also as a mirror image to partition wall 12 or asymmetrically to partition wall 12 in bottom 14; these allow additional elasticity for bottom 14 to compensate such shifts of bottom 14.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

a tube-fin block that is fluidically connected to two collecting tanks;

tubes having ends that engage in a bottom of each of the collecting tanks, the bottom of each of the collecting tanks being closed with a cover;

a partition wall secured to the cover of at least one of the collecting tanks, the partition wall being formed transverse to a longitudinal extension of the at least one of the collecting tanks and dividing an interior space of the at least one of the collecting tanks into two sub-chambers; and first stress decoupling devices formed in the bottom of the at least one of the collecting tanks in an area of the partition wall and a second stress decoupling device formed in the area of the partition wall in the cover of the at least one of the collecting tanks, wherein, in each of the first stress decoupling devices, a slot that runs in a longitudinal direction of the bottom of the at least one of the collecting tanks is provided, wherein the slot is expanded by a further slot that runs in the transverse direction of the bottom of the at least one of the collecting tanks, wherein the slot and the further slot are each formed as through-holes that extend entirely through the bottom of the at least one of the collecting tanks, wherein the second stress decoupling device is provided in an upper surface of the cover of the at least one of the collecting tanks and is formed as a corrugation, wherein a circumferential border of the cover of the at least one of the collecting tanks, provided at side surfaces of the cover, is formed as a corrugated flange, and wherein a first one of the two subchambers has a higher temperature than a second one of the two subchambers, and wherein by being formed in the area of the partition wall, the first stress decoupling devices are only located in an area of the bottom of the at least one of the collecting tanks between a supply connector and an outlet connector, such that a step offset is provided between the two subchambers to relieve stresses transmitted via the bottom to the tubes.

2. The heat exchanger according to claim 1, wherein the corrugation is formed V- or U-shaped.

3. The heat exchanger according to claim 1, wherein the cover of the at least one of the collecting tanks is lowered in the area of the partition wall in a direction of the bottom of the at least one of the collecting tanks, and wherein the partition wall is formed between the corrugation and the circumferential border of the cover of the at least one of the collecting tanks.

4. The heat exchanger according to claim 3, wherein a height of the partition wall resting on the bottom of the at least one of the collecting tanks corresponds to <50% of a total height of the cover of the at least one of the collecting tanks.

5. The heat exchanger according to claim 3, wherein a height of the partition wall corresponds to between 1 and 100% of a height of the circumferential border of the cover of the at least one of the collecting tanks.

6. The heat exchanger according to claim 1, wherein a seal or a sealing frame is arranged between the partition wall and the bottom of the at least one of the collecting tanks.

7. The heat exchanger according to claim 1, wherein the first stress decoupling devices of the bottom of the at least one of the collecting tanks are formed as an attenuation elasticity.

8. The heat exchanger according to claim 1, wherein the cover of the at least one of the collecting tanks has one medium inlet connector and two medium outlet connectors, wherein the medium inlet connector is associated with the first one of the two subchambers formed by the partition wall and the two medium outlet connectors are associated with the second one of the two subchambers.

* * * * *